US007414368B2

(12) United States Patent
Rintamaki et al.

(10) Patent No.: US 7,414,368 B2
(45) Date of Patent: Aug. 19, 2008

(54) CERAMIC METAL HALIDE LAMP WITH CERIUM-CONTAINING FILL

(75) Inventors: Joshua I. Rintamaki, Westlake, OH (US); Dennis S. Bradley, Twinsburg, OH (US)

(73) Assignee: General Electric Company, Schenectady, NY (US)

( * ) Notice: Subject to any disclaimer, the term of this patent is extended or adjusted under 35 U.S.C. 154(b) by 495 days.

(21) Appl. No.: 11/040,990

(22) Filed: Jan. 21, 2005

(65) Prior Publication Data

US 2006/0164017 A1 Jul. 27, 2006

(51) Int. Cl.
*H01J 17/20* (2006.01)

(52) U.S. Cl. ..... 313/637; 313/640; 313/641; 313/638; 313/571; 313/572; 315/56

(58) Field of Classification Search ..... None
See application file for complete search history.

(56) References Cited

U.S. PATENT DOCUMENTS 3,786,297 A 1/1974 Zollweg et al.
3,798,487 A 3/1974 Zollweg et al.
6,555,962 B1 4/2003 Jackson et al.
6,583,563 B1 6/2003 Venkataramani et al.
6,731,068 B2 5/2004 Dakin et al.
7,138,765 B2 * 11/2006 Anami et al. ..... 313/620
2003/0020408 A1 * 1/2003 Higashi et al. ..... 313/637
2003/0222595 A1 12/2003 Chen et al.
2003/0222596 A1 12/2003 Chen et al.
2005/0082985 A1 * 4/2005 Geijtenbeek et al. ..... 313/634
2005/0194908 A1 * 9/2005 Dakin et al. ..... 315/56
2005/0248279 A1 * 11/2005 Lambrechts et al. ..... 313/640

* cited by examiner

*Primary Examiner*—Sikha Roy
(74) *Attorney, Agent, or Firm*—Fay Sharpe LLP

(57) ABSTRACT

A metal halide lamp (10) includes a discharge vessel (12) which may be formed of a ceramic material. The vessel defines an interior space (16). An ionizable fill is disposed in the interior space. The ionizable fill includes an inert gas and a halide component. The halide component includes a sodium halide, a cerium halide, at least one of a thallium halide and an indium halide, and optionally a cesium halide. The cerium halide is at least about 9 mol % of the halide component. At least one electrode (18, 20) is positioned within the discharge vessel so as to energize the fill when an electric current is applied thereto.

33 Claims, 5 Drawing Sheets

CERAMIC METAL HALIDE LAMP WITH CERIUM-CONTAINING FILL

BACKGROUND OF THE INVENTION

The present invention relates to an electric lamp with high efficiency, good color rendering, and high lamp lumen maintenance.

Discharge lamps produce light by ionizing a vapor fill material such as a mixture of rare gases, metal halides and mercury with an electric arc passing between two electrodes. The electrodes and the fill material are sealed within a translucent or transparent discharge chamber which maintains the pressure of the energized fill material and allows the emitted light to pass through it. The fill material, also known as a "dose," emits a desired spectral energy distribution in response to being excited by the electric arc. For example, halides provide spectral energy distributions that offer a broad choice of light properties, e.g. color temperatures, color renderings, and luminous efficacies.

Conventionally, the discharge chamber in a discharge lamp was formed from a vitreous material such as fused quartz, which was shaped into desired chamber geometries after being heated to a softened state. Fused quartz, however, has certain disadvantages which arise from its reactive properties at high operating temperatures. For example, in a quartz lamp, at temperatures greater than about 950-1000° C., the halide filling reacts with the glass to produce silicates and silicon halide, which results in depletion of the fill constituents. Elevated temperatures also cause sodium to permeate through the quartz wall, which causes depletion of the fill. Both depletions cause color shift over time, which reduces the useful lifetime of the lamp. Color rendition, as measured by the color rendering index (CRI or Ra) tends to be moderate in existing quartz metal halide (QMH) lamps, typically in the range of 65-70 CRI, with moderate lumen maintenance, typically 65-70%, and moderate to high efficacies of 100-150 lumens per watt (LPW). U.S. Pat. Nos. 3,786,297 and 3,798,487 disclose quartz lamps which use high concentrations of cerium iodide in the fill to achieve relatively high efficiencies of 130 LPW at the expense of the CRI. These lamps are limited in performance by the maximum wall temperature achievable in the quartz arctube.

A conventional metal halide lamp is fabricated by charging, in a light-transmitting quartz tube, mercury, an inert gas, e.g., argon, and a halide mixture including at least one kind of rare earth halide and an alkali metal halide, and sealing the tube.

Ceramic discharge chambers were developed to operate at higher temperatures for improved color temperatures, color renderings, and luminous efficacies, while significantly reducing reactions with the fill material. In general, CMH lamps are operated on an AC voltage supply source with a frequency of 50 or 60 Hz, if operated on an electromagnetic ballast, or higher if operated on an electronic ballast. The discharge is extinguished, and subsequently re-ignited in the lamp, upon each polarity change in the supply voltage.

U.S. Pat. No. 6,583,563 discloses a ceramic metal halide lampcapable of operating at over 150 watts. The body portion has a length of an inner diameter of about 9.5 mm and outer diameter of about 11.5 mm. U.S. Pat. No. 6,555,962 discloses a metal halide lamp with a power rating of 200 W or more to be used with an existing ballast for a high pressure sodium (HPS) lamp of like power rating. The inside diameter D and inside length L are selected so as to provide an aspect ratio L/D of between 3 and 5. U.S. application Ser. No. 10/792,996, filed Mar. 4, 2004, discloses a CMH lamp having a ceramic arctube in which the length and diameter are selected such that the lamp is capable of operating in the range of 250-400 W with a CRI of at least 85 and an efficiency of at least 90 lumens/watt.

For commercial metal halide lamps of high wattage, lumen maintenance (measured as the percentage of lumens retained at the mean lifetime of the lamp as compared with the lumens at 100 hours) is generally low, typically only about 65% or less, often only about 50%. Thus, a conventional 400 W lamp, while it may have a high initial lumen output, will only have a lumen output comparable to a new 250 W lamp by its mean lifetime of about 8000-10,000 hours.

The present invention provides a new and improved metal halide lamp capable of operating at high or low power which has a high efficiency and good lamp lumen maintenance.

BRIEF DESCRIPTION OF THE INVENTION

In an exemplary embodiment, a ceramic metal halide lamp is provided. The lamp includes a discharge vessel formed of a ceramic material which defines an interior space. An ionizable fill is disposed in the interior space. The ionizable fill includes an inert gas and a halide component. The halide component includes a sodium halide, a cerium halide, a thallium halide, and optionally at least one of an indium halide and a cesium halide. The cerium halide may constitute at least 9 mol % of the halide component. The sodium halide may constitute at least 47 mol % of the halides in the fill. At least one electrode is positioned within the discharge vessel so as to energize the fill when an electric current is applied thereto.

In another exemplary embodiment, a lighting assembly is provided. The assembly includes a ballast and a lamp electrically connected therewith. The lamp includes a discharge vessel containing a fill of an ionizable material and at least one electrode positioned within the discharge vessel so as to energize the fill when an electric current is applied thereto. The discharge vessel includes a body portion which defines an interior space. The body portion has an internal length, parallel to a central axis of the discharge vessel and an internal diameter, perpendicular to the internal length. A ratio of the internal length to the internal diameter is in the range of 1.5 to 3.5. The fill includes an inert gas and a halide component. The halide component includes at least one alkali metal halide and at least one rare earth metal halide, and optionally at least one group IIIa halide, the rare earth halide comprising cerium halide at a molar percentage of at least 9% of the halide component.

In another exemplary embodiment, a method of forming a lamp is provided. The method includes providing a substantially cylindrical discharge vessel comprising a body portion and first and second leg portions extending from the body portion. An ionizable fill is disposed in the body portion and includes an inert gas and a halide component. The halide component includes a sodium halide, a cerium halide, a thallium halide, and optionally at least one of an indium halide and a cesium halide. The cerium halide may be at least 9 mol % of the halide component. The sodium halide may be present at a molar percent which is at least twice the molar percent of the cerium halide. Electrodes are positioned within the discharge vessel which energize the fill when an electric current is applied thereto.

One advantage of at least one embodiment of the present invention is the provision of a ceramic arctube fill with improved performance and lumen maintenance.

Another advantage of at least one embodiment of the present invention is the provision of a lamp capable of running on an electronic ballast.

Another advantage of at least one embodiment of the present invention is that the relationship between structural elements such as dimensions of the arctube are optimized.

Still further advantages of the present invention will become apparent to those of ordinary skill in the art upon reading and understanding the following detailed description of the preferred embodiments.

As used herein, "Arctube Wall Loading" (WL) is the arctube power (watts) divided by the arctube surface area (square mm). For purposes of calculating WL, the surface area is the total external surface area including end bowls but excluding legs, and the arctube power is the total arctube power including electrode power.

The "Ceramic Wall Thickness" (ttb) is defined as the thickness (mm) of the wall material in the central portion of the arctube body.

The "Aspect Ratio" (L/D) is defined as the internal arctube length divided by the internal arctube diameter.

The "Halide Weight" (HW) is defined as the weight (mg) of the halides in the arctube.

DETAILED DESCRIPTION OF THE INVENTION

A discharge lamp suited to a variety of applications has a high efficiency and good lamp lumen maintenance. While particular reference is made herein to operation of the lamp at high wattage (above about 150 W), the lamp is suited to use in a variety of applications, including operation at below 150 W. In one embodiment, the lamp has an operating voltage between about 120 and 180 volts when burned vertically which translates to between 130 and 190 volts when burned horizontally, and a power of greater than 200 watts, e.g., between about 250 W and 400 W. Furthermore, the lamp may provide a corrected color temperature (CCT) between about 2500 K and about 4500 K, e.g., between about 3500 K and 4500 K. The lamp may have a color rendering index, Ra>70, e.g., 75<Ra<85. The color rendering index is a measure of the ability of the human eye to distinguish colors by the light of the lamp. The present inventors have found, for many applications, such as in industrial and high bay warehouse-style stores, that having a high CRI is not critical and that a lamp with a higher proportion of green light (i.e., above the curve, in the y axis direction, for standard black body radiation) is more advantageous than a comparable lamp of somewhat higher Ra but with a lower proportion of green light. More lumens are perceived from "green" light due to the eye's greater response to light in the visible "green" spectra.

In one embodiment the lumens per watt (LPW) of the lamp at 100 hours of operation is at least 100, and in one specific embodiment, at least 110. The lumen maintenance, measured as: Lumens at 8000 hrs, can be at least about 80%.

Lumens at 100 hrs

All of these ranges may be simultaneously satisfied in the present lamp design.

The 80% lumen maintenance, or higher, is much greater than for a typical metal halide lamp, particularly one of high wattage. Three factors are thought to contribute to the unexpectedly high lumen maintenance:

1. Lamp design—in particular, the L/D ratio and three part construction (discussed below);
2. Arctube fill—which has been formulated to reduce arctube corrosion; and
3. Ballast—the lamp has been designed to run on an electronic ballast, the start up characteristics of which favor long life and improved lumen maintenance.

It will be appreciated that not all these factors need be present in the lamp to achieve benefits in lumen maintenance. For example, benefits in lumen maintenance can be seen using the arctube fill characteristics alone.

Figure 1:
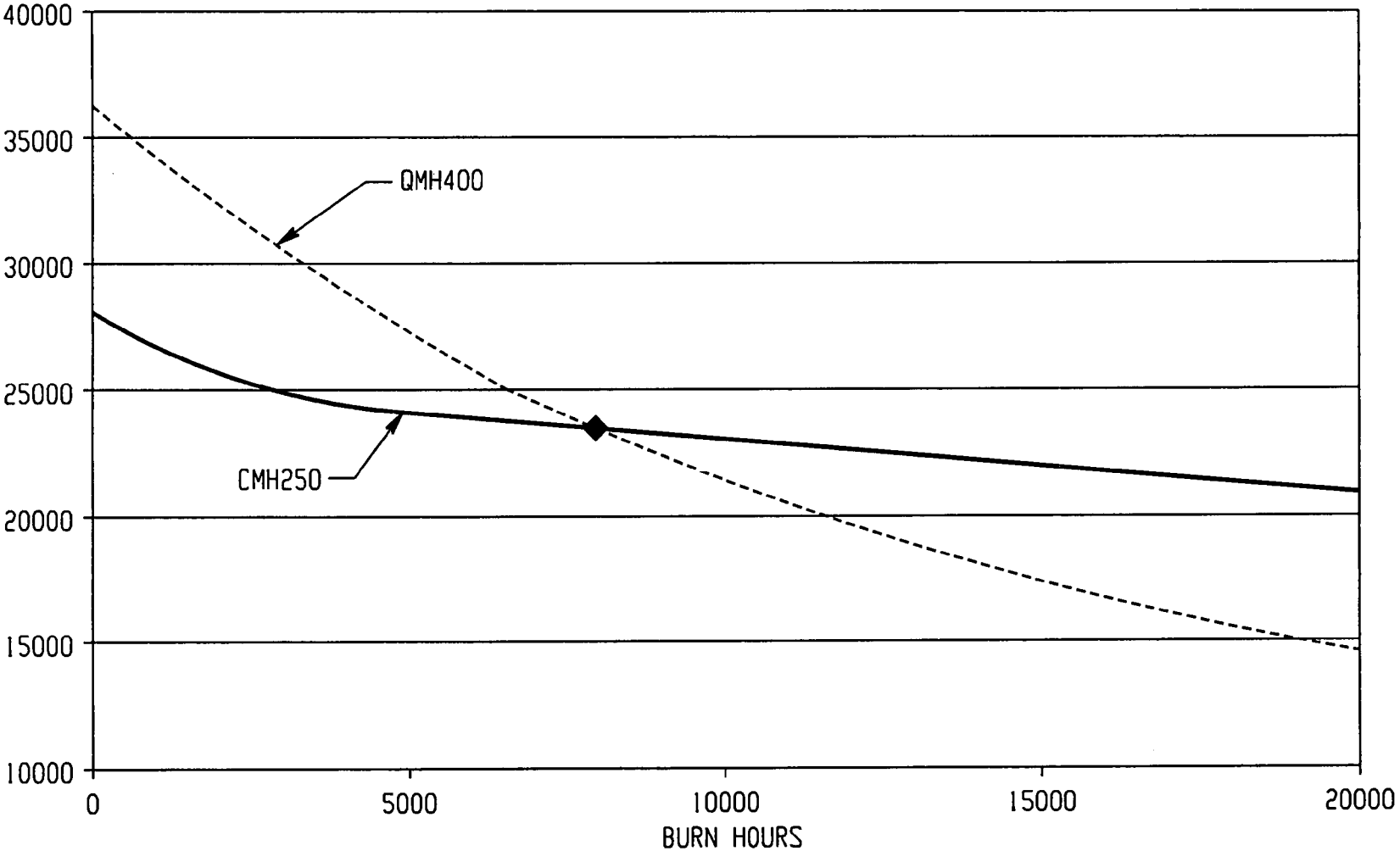
FIG. 1 is a theoretical plot of lumens vs. time for a conventional 400 W QMH lamp compared with a 250 W lamp formed according to the present invention.

For example, a 250 W ceramic metal halide (CMH) lamp according to the present design can be substituted for a conventional 400 W quartz metal halide (QMH) lamp and provide comparable mean lumen output over the lifetime of the lamp, at significantly reduced power consumption. FIG. 1 demonstrates the benefits of a lumen maintenance of 80% in a 250 W CMH lamp of the present embodiment, compared with a conventional 400 W QMH lamp. At first, the 400 W QMH lamp has a higher lumen output, due to its higher wattage, but by about 8000 hours, the curves cross and at longer times the CMH lamp has a higher lumen output than the QMH lamp. Thus, averaged over the lifetime of the lamp, the CMH 250 W lamp has a comparable if not higher lumen output than the conventional 400 W QMH lamp, a significant saving in power consumption.

Figure 2:
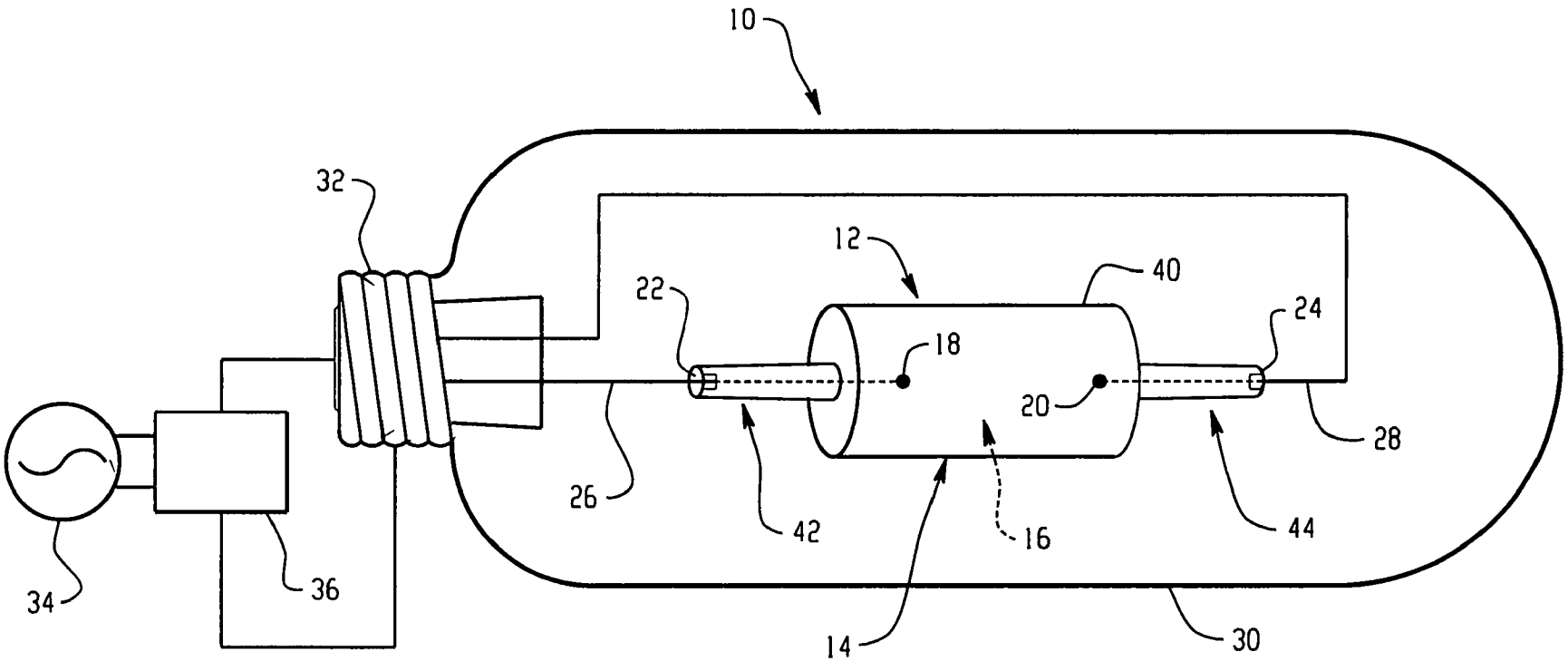
FIG. 2 is a perspective view of a lamp according to the invention.

With reference to FIG. 2, a lighting assembly includes a metal halide discharge lamp 10. The lamp includes a discharge vessel or arctube 12 having a wall 14 formed of a ceramic or other suitable material, which encloses a discharge space 16. The discharge space contains an ionizable fill material. Electrodes 18, 20 extend through opposed ends 22, 24 of the arctube and receive current from conductors 26, 28 which supply a potential difference across the arctube and also support the arctube 12 The arctube 12 is surrounded by an outer bulb 30, which is provided with a lamp cap 32 at one end through which the lamp is connected with a source of power 34, such as mains voltage. The lighting assembly also includes a ballast 36, which acts as a starter when the lamp is switched on. The ballast is located in a circuit containing the lamp and the power source. The space between the arctube and outer bulb may be evacuated. Optionally a shroud (not shown) formed from quartz or other suitable material, surrounds or partially surrounds the arctube to contain possible arctube fragments in the event of an arctube rupture.

The ballast 36 can be of any suitable type designed to operate at the operating wattage of the lamp. One particularly suitable ballast is an electronic ballast. Electronic ballasts generally comprise a half-bridge inverter, a current transformer, and a load circuit including the discharge lamp. The current transformer includes a detecting winding and a feedback winding. The feedback winding generates a driving signal of switching elements of the half-bridge inverter. An exemplary electronic ballast of this type is sold under the tradename ULTRAMAX HID™ by General Electric. Another suitable ballast is a Delta Power ballast (Delta Power Supply, Inc.). Other suitable electronic ballasts are described, for example in US Published Application Nos. 20030222596 and 20030222595 to Chen, et al. The ballast described in the '596 application, for example, is a single stage High Intensity Discharge (HID) ballast which includes a switching section connected to a first bus and a second bus and configured to output a high frequency voltage signal. A bridge converter section has two legs, each including two series connected bridge diodes, with each leg being connected to each bus. The converter is configured to receive an input signal from the power source and to convert the input signal into a form usable by the switching section. The bridge converter section is integrated with the switching section to provide the usable signal to the switching section and to contribute to operation of the switching section. An active switching system is configured to provide a desired balance between input power and output power.

Other types of ballast are magnetic ballasts, such as Pulse Arc (PA) ballasts and High Pressure Sodium (HPS) ballasts. These ballasts can be configured for operating at 200 W and above, as well as at lower wattages. PulseArc or "PA" ballasts (also known as pulse start ballasts) include an ignitor pulse-forming network (pulsing circuit) to initiate lamp starting, eliminating the need for a starter electrode and associated components (bi-metal switch and resistor). PA ballasts are suited to operation with lamps which operate at a nominal Vop=135±15V and a nominal arctube power factor of about 0.91. HPS ballasts are widely used for high pressure sodium lamps and can be used with lamps that are capable of operating at a nominal operating voltage $V_{op}$ of 100±20V initially. The lamps suited to use with these ballasts also have a nominal arctube power factor, defined as operating power, divided by current times voltage, of about 0.87. As noted above, however, where lamp life and lumen maintenance are important factors, an electronic ballast may perform more favorably than a magnetic ballast.

In operation, the electrodes 18, 20, produce an arc which ionizes the fill material to produce a plasma in the discharge space. The emission characteristics of the light produced are dependent, primarily, upon the constituents of the fill material, the voltage across the electrodes, the temperature distribution of the chamber, the pressure in the chamber, and the geometry of the chamber.

For a ceramic metal halide lamp, the fill material comprises a mixture of mercury, a an inert gas such as argon, krypton or xenon, and a halide component which includes one or more halides of a rare earth metal (RE) selected from scandium, yttrium, lanthanum, cerium, praseodymium, neodymium, promethium, samarium, europium, gadolinium, terbium, dysprosium, holmium, erbium, thulium, ytterbium and lutetium. In addition, the halide component may include one or more halides of alkali metals, such as sodium and cesium, and one or more metal halides selected from Group 3a of the periodic table of the elements, such as indium and thallium. Optionally, the halide component includes one or more alkaline earth metal halides, such as calcium, strontium, and barium.

The mercury dose may comprise about 3 to 20 mg per cc of arc tube volume. Typically, the halide element is selected from chloride, bromide and iodide. Iodides tend to provide higher lumen maintenance as corrosion of the arctube is lower than with the comparable bromide or chloride. The halide compounds usually will represent stoichiometric relationships. Exemplary metal halides include NaI, TlI, $DyI_3$, $HoI_3$, $TmI_3$, InI, $CeI_3$, $CaI_2$, and CsI, and combinations thereof.

The mercury weight is adjusted to provide the desired arctube operating voltage (Vop) for drawing power from the selected ballast.

The metal halide arctubes are back filled with a inert gas, to facilitate starting. For the inert gas, Xenon has advantages over argon as an ignition gas because the atoms are larger and inhibit evaporation of the tungsten electrodes, so that the lamp lasts longer. In one embodiment, suited to CMH lamps, the lamp is backfilled with Xe with a small addition of Kr85. The radioactive Kr85 provides ionization which helps starting. The cold fill pressure can be about 60-300 Torr. In one embodiment, a cold fill pressure of at least about 120 Torr is used. In another embodiment, the cold fill pressure is up to about 240 torr. A too high pressure can compromise starting. A too low pressure can lead to increased lumen depreciation over life.

In one embodiment, the halide component comprises halides of Na, Ce, Tl, and optionally In and/or Cs. The cerium halide, e.g., cerium bromide, may be present at a concentration of at least 9% of the halides in the fill. The sodium halide may be present at a molar percent which is at least twice the molar percent of the cerium halide, e.g., at least about 47 mol % of the halides in the fill.

In one exemplary embodiment, the fill gas includes Ar or Xe and a trace amount of Kr85, Hg, and a halide component. For example, the halide component can include the components listed in TABLE 1.

For example, a halide fill comprising 35-65% NaI, 25-45% $CeI_3$, 5-10% TlI, 1-5% InI, and 0-10% CsI, either alone or with minor amounts of other halides, is suitable for achieving a color rendering index (Ra) of >75, Efficiency of >100 LPW, and a color correction temperature (CCT) of ~4000K on an electronic ballast. Such a lamp is designed to have a mean lifetime of at least 16,000 hrs, and in one embodiment, about 20,000 hrs, with few premature failures in the 100 to 1000 hour range.

In one embodiment, other halides than Na, Ce, Tl, In, and Cs are also present at a total of no more than 10% by weight. These other halides may include one or more halides of a rare earth metal (RE) selected from scandium, yttrium, lanthanum, praseodymium, neodymium, promethium, samarium, europium, gadolinium, terbium, dysprosium, holmium, erbium, thulium, ytterbium and lutetium, and/or one or more alkaline earth metal halides, such as calcium, strontium, and barium halides.

$CeI_3$ and TlI contribute to the slightly green appearance of the light, without creating an unpleasant appearance. These may exhibit some instability in the plasma, which can be overcome by the presence of CsI.

TABLE 1

| Halide | Mol % in Halide Component | Exemplary Mol % in Halide Component | Weight % in halide component (for iodide) | Exemplary Weight % in halide component (for iodide) |
|---|---|---|---|---|
| Na | At least about 47%, in one embodiment at least about 59%, in | 77.3 | At least about 25%, in one embodiment, at least about 35%, in one | 54 |

TABLE 1-continued

| Halide | Mol % in Halide Component | Exemplary Mol % in Halide Component | Weight % in halide component (for iodide) | Exemplary Weight % in halide component (for iodide) |
|---|---|---|---|---|
| | one embodiment, less than 93%, in another embodiment, less than about 83%, e.g., 59-83% | | embodiment, up to about 80%, in another embodiment up to about 65%, and in another embodiment, up to about 55%, e.g., 35-65%. | |
| Ce | At least about 9%, in one embodiment, at least 11%, in another embodiment, less than 27%, and in another embodiment, less than about 22%, e.g., 9-22% | 14.4 | At least about 20%, in one embodiment, at least about 25%, and in another embodiment, at least 30%. In one embodiment, less than about 50% and in another embodiment, less than about 45%, e.g., 25-45% | 35 |
| Tl | Optionally 0%. In one embodiment, at least about 1.2%, in another embodiment, at least about 2.3%, in another embodiment, less than 8%, e.g., 2.3-8% | 3.2 | Optionally 0%. In one embodiment, at least about 2%, in another embodiment, at least about 4%, in another embodiment, less than 10%, e.g., 4-10% | 5 |
| In | Optionally 0%. In one embodiment, at least about 1.1%, in one embodiment, less than 4.0%, e.g., 1.1-4.0% | 1.8 | Optionally 0%. In one embodiment, at least about 1%, e.g., 1-5% | 2 |
| Cs | Optionally 0%, in one embodiment, at least 1.5%, in another embodiment, less than 10.0%, e.g., 1.5-10.0% | 3.3 | Optionally 0, e.g., 0-10%, in one embodiment, at least about 2% | 4 |
| Total | | 100 | | 100 |

Figure 3:
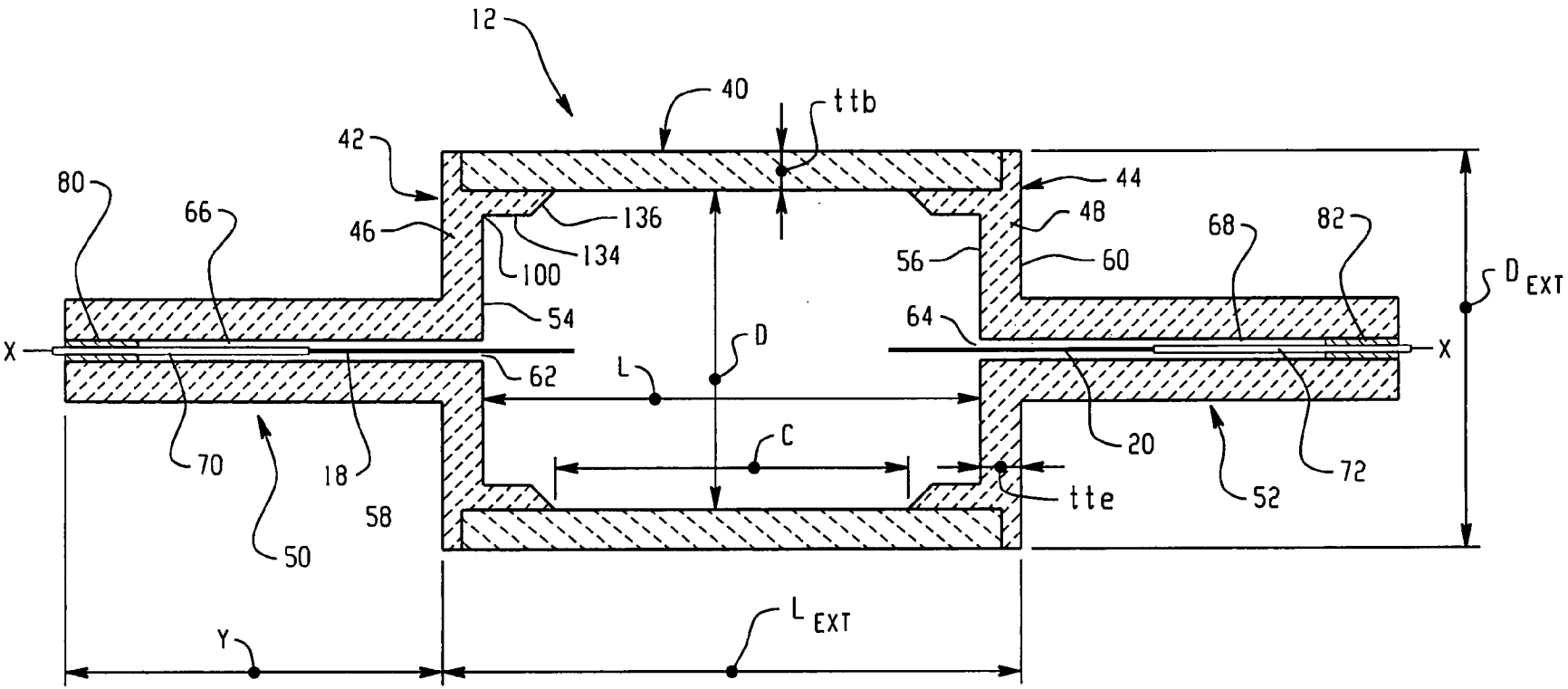
FIG. 3 is a diagrammatic axial section view of a discharge vessel for the lamp of FIG. 2 according to a first embodiment of the invention.

With reference also to FIG. 3, the illustrated arctube 12 can be of a three part construction. Specifically, the arctube 12 includes a body portion 40 extending between end portions 42, 44. The body portion is preferably cylindrical or substantially cylindrical about a central axis x. By "substantially cylindrical" it is meant that the internal diameter D of the body portion does not vary by more than 10% within a central region C of the body portion which accounts for at least 40% of the interior length L of the body portion. Thus, a slightly elliptical body can be achieved without losing all of the advantages of the present invention. In one embodiment, the variation is less than 5% and in another embodiment, the variation is within the tolerances of the lamp forming process for a nominally cylindrical body. Where the diameter varies, D is measured at its widest point. The end portions, in the illustrated embodiment, are each integrally formed and comprise a generally disk-shaped wall portion 46, 48 and an axially extending hollow leg portion 50, 52, through which the respective electrodes are fitted. The leg portions may be cylindrical, as shown, or taper such that the external diameter decreases away from the body portion 40, as illustrated by the hatched lines in FIG. 3.

The wall portions 46, 48 define interior wall surfaces 54, 56 and exterior end wall surfaces 58, 60 of the discharge space; the maximum distance between the interior surfaces 54, 56, as measured along a line parallel to the axis x of the arctube being defined as L and the distance between exterior wall surfaces 58, 60 being defined as $L_{EXT}$. The cylindrical wall 40 has an internal diameter D (the maximum diameter, as measured in the central region defined by C) and an exterior diameter $D_{EXT}$.

For the arctube power range 250-400 W the ratio L/D can be in the range of about 1.5 to 3.5, in one embodiment, about 2.0 to about 3.0. In one specific embodiment, L/D is from 2.2 to 2.8. The L/D ratio can be outside these ranges, particularly if the color temperature is not considered to be of particular importance.

The end portions 42, 44 are fastened in a gas tight manner to the cylindrical wall 40 by means of a sintered joint. The end wall portions each have an opening 62, 64 defined at an interior end of an axial bore 66, 68 through the respective leg portion 50, 52. The bores 66, 68 receive leadwires 70, 72 through seals 80, 82. The electrodes 18, 20, which are electrically connected to the leadwires, and hence to the conductors, typically comprise tungsten and are about 8-10 mm in length. The leadwires 70, 72 typically comprise niobium and molybdenum which have thermal expansion coefficients close to that of alumina to reduce thermally induced stresses on the alumina leg portions and may have halide resistant sleeves formed, for example of Mo—$Al_2O_3$.

The halide weight (HW) in mg can be in the range of about 20 to about 70 mg If HW is too small, then the halides tend to be confined to the ceramic legs, which are intentionally cooler than the arctube body, and there tends to be inadequate halide vapor pressure to provide the desired arctube performance. If HW is too large, then halide tends to condense on the arctube walls where it blocks light and may lead to life limiting corrosion of the ceramic material. Under such conditions, polycrystalline alumina (PCA), in particular, tends to dissolve into the condensed liquid and is later deposited on cooler areas of the lamp. A high HW also tends to increase manufacturing cost due to the cost of the halides. In the present lamp, the end walls are hotter so the amount of halide on the walls is reduced and thus corrosion is minimized or eliminated entirely.

The ceramic wall thickness (ttb), which is equivalent to $(D_{ext}-D)/2$, as measured in the cylindrical portion 40 is preferably at least 1 mm for artubes operating in the range of 250-400 W. In one embodiment, the thickness is less than 1.8 mm for arctubes operating in this range. If ttb is too low, then there tends to be inadequate heat spreading in the wall through thermal conduction. This can lead to a hot local hot spot above the convective plume of the arc, which in turn causes cracking as well as a reduced limit on WL. A thicker wall spreads the heat, reducing cracking and enabling higher WL. In general, the optimum ttb increases with the size of the arctube; higher wattages benefiting from larger arctubes with thicker walls. In one embodiment, where the arctube power is in the range of 250-400 W, 1.1 mm<ttb<1.5 mm. For such an arctube, the wall loading WL may meet the expression $0.10<WL<0.20\ W/mm^2$. If WL is too high then the arctube material may tend to become too hot, leading to softening in the case of quartz, or evaporation in the case of ceramic. If WL is too low then the halide temperature tends to be too low leading to reduced halide vapor pressure and reduced performance. In one specific embodiment, 1.3<ttb<1.5. The thickness tte of the end walls 46, 48 is preferably the same as that of the body 40, i.e., in one embodiment 1.1 mm<tte<1.5 mm. For lower wattages, e.g., less than about 200 W, the wall thickness ttb can be somewhat lower.

The arc gap (AG) is the distance between tips of the electrodes 18, 20. The arc gap is related to the internal arctube length L by the relationship AG+2tts=L, where tts is the distance from the electrode tip to the respective surface 54, 56 defining the internal end of the arctube body. Optimization of tts leads to an end structure hot enough to provide the desired halide pressure, but not too hot to initiate corrosion of the ceramic material. In one embodiment, tts is about 2.9-3.3 mm. In another embodiment, tts ~3.1 mm.

The arctube legs 50, 52 provide a thermal transition between the higher ceramic body-end temperatures desirable for arctube performance and the lower temperatures desirable for maintaining the seals 80, 82 at the ends of the legs. The minimum internal diameter of the legs is dependent on the electrode-conductor diameter, which in turn is dependent on the arc current to be supported during starting and continuous operation. In an exemplary embodiment, where the power is in the range of 250-400 W, an external conductor diameter of about 1.52 mm can be employed. Smaller diameters may be appropriate for lower wattages. A ceramic leg 50, 52 whose internal and external diameters are about 1.6 and 4.0 mm, respectively is therefore suitable for such a conductor 70, 72. With these selected diameters, an external ceramic leg length Y of greater than 15 mm is generally sufficient to avoid seal cracking. In one embodiment, the legs 50, 52 each have a leg length of about 20 mm.

Figure 4:
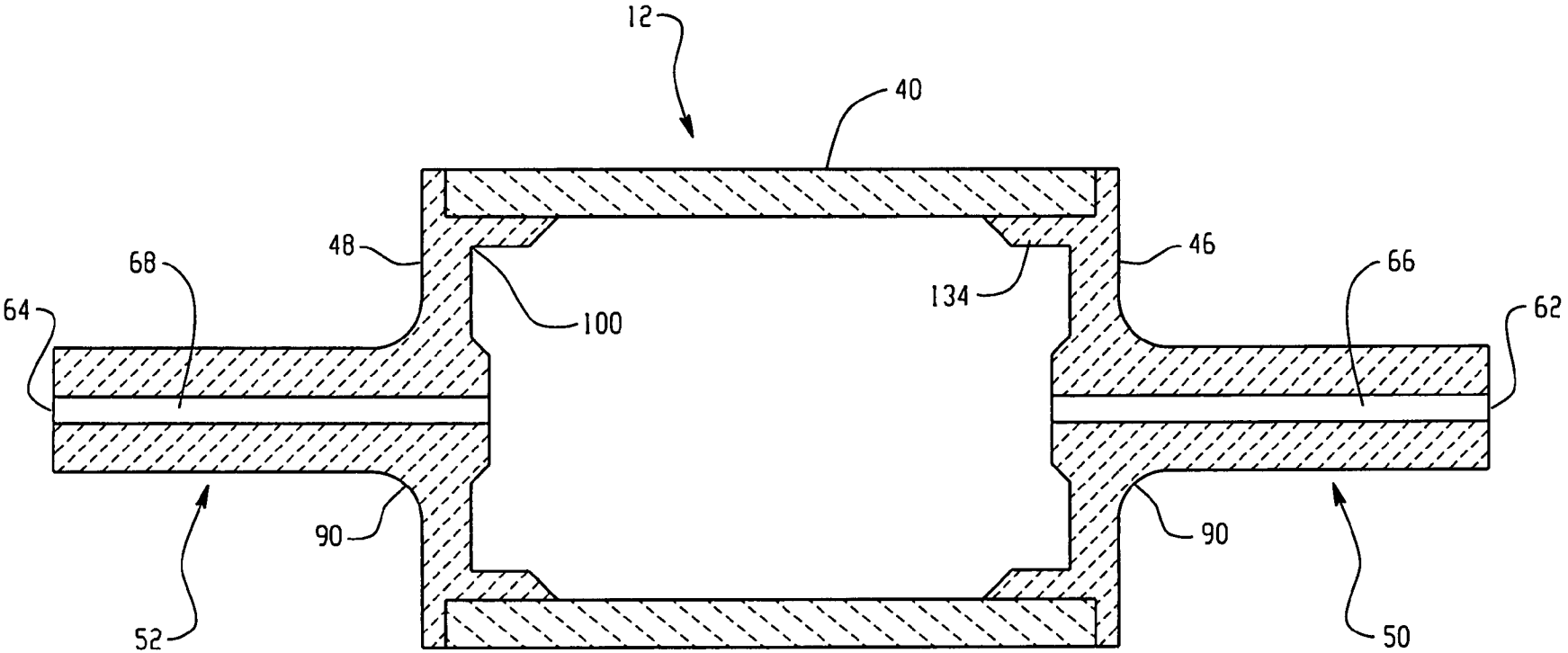
FIG. 4 is a diagrammatic axial section view of a discharge vessel for the lamp of FIG. 2 according to a second embodiment of the invention.

The cross sectional shape of the end wall portions 46, 48 which join the arctube body 40 to its legs 50, 52 can be one in which a sharp corner is formed at the intersection between the end wall portion 46, 48 and the leg, as illustrated in FIG. 3. However, as illustrated in FIG. 4 a fillet 90 in the region of the intersection is alternatively provided. A smooth fillet transition between the exterior end and the leg and the end wall portion assists in reducing stress concentrations at the intersection.

The end wall portions are provided with a thickness large enough to spread heat but small enough to prevent or minimize light blockage. Discrete interior corners 100 provide a preferred location for halide condensation. The structure of the endwall portion 46, 48 enables a more favorable optimization, significantly one with a lower L/D. The following features, alone or in combination, have been found to assist in optimizing performance: 1) a smooth fillet transition between the exterior end and the leg so as to reduce stress concentrations, 2) an end thickness large enough to spread heat but small enough to prevent light blockage, and 3) discrete corners to provide a preferred location for halide condensation.

The seals 80, 82 typically comprise a dysprosia-alumina-silica glass and can be formed by placing a glass frit in the shape of a ring around one of the leadwires 70, 72, aligning the arctube 12 vertically, and melting the frit. The melted glass then flows down into the leg 50, 52, forming a seal 80, 82 between the conductor and the leg. The arctube is then turned upside down to seal the other leg after being filled with the fill material.

Figure 5:
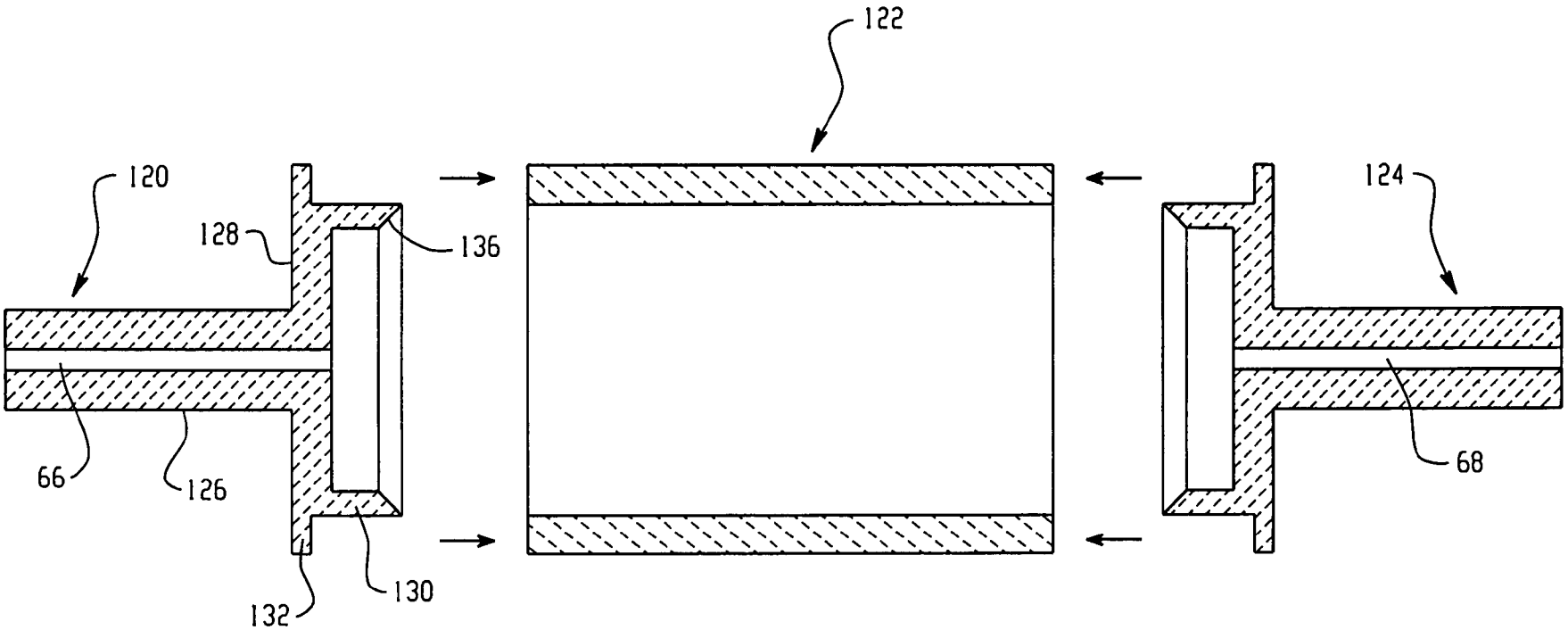
FIG. 5 is an exploded perspective view of the lamp of FIG. 2.

The exemplary body and plug members 120, 122, 124 shown in FIG. 5 can greatly facilitate manufacturing of the discharge chamber, since the plug members 120, 124 include a leg member 126 and an end wall member 128, and an axially directed flange 130 formed as a single piece. A radially extending flange 132 is configured for seating against the opposed ends of the body 122. The components shown in FIG. 5 allow the discharge chamber to be constructed with a single bond between each plug member 120, 124 and the body member 122. The flange 130 is seated within the body during assembly, and forms a thickened wall portion 134 (FIG. 3) of the body in the assembled arc tube. The inner edge of the flange 130 has an upward taper 136, which is seated with the highest, outer, edge in contact with the inside of the body portion, so as to discourage any of the fill from settling around the junction between the wall 134 and the body portion.

It will be appreciated that the arc tube can be constructed from fewer or greater number of components, such as one or five components. In a five component structure, the plug members are replaced by separate leg and end wall members which are bonded to each other during assembly.

The body member 122 and the plug members 120, 124 can be constructed by die pressing a mixture of a ceramic powder and a binder into a solid cylinder. Typically, the mixture comprises 95-98% by weight ceramic powder and 2-5% by weight organic binder. The ceramic powder may comprise alumina ($Al_2O_3$) having a purity of at least 99.98% and a surface area of about 2-10 $m^2/g$. The alumina powder may be doped with magnesia to inhibit grain growth, for example in an amount equal to 0.03%-0.2%, in one embodiment, 0.05%, by weight of the alumina. Other ceramic materials which may be used include non reactive refractory oxides and oxynitrides such as yttrium oxide, lutetium oxide, and hafnium oxide and their solid solutions and compounds with alumina such as yttrium-aluminum-garnet and aluminum oxynitride. Binders which may be used individually or in combination include organic polymers such as polyols, polyvinyl alcohol, vinyl acetates, acrylates, cellulosics and polyesters.

An exemplary composition which can be used for die pressing a solid cylinder comprises 97% by weight alumina powder having a surface area of 7 $m^2/g$, available from Baikowski International, Charlotte, N.C. as product number CR7. The alumina powder was doped with magnesia in the amount of 0.1% of the weight of the alumina. An exemplary binder includes 2.5% by weight polyvinyl alcohol and ½% by weight Carbowax 600, available from Interstate Chemical.

Subsequent to die pressing, the binder is removed from the green part, typically by thermal pyrolysis, to form a bisque-fired part. The thermal pyrolysis may be conducted, for example, by heating the green part in air from room temperature to a maximum temperature of about 900-1100° C. over 4-8 hours, then holding the maximum temperature for 1-5 hours, and then cooling the part. After thermal pyrolysis, the porosity of the bisque-fired part is typically about 40-50%.

The bisque-fired part is then machined. For example, a small bore may be drilled along the axis of the solid cylinder which provides the bore 66, 68 of the plug portion 120, 124 in FIG. 4. A larger diameter bore may be drilled along a portion of the axis of the plug portion to define the flange 130. Finally, the outer portion of the originally solid cylinder may be machined away along part of the axis, for example with a lathe, to form the outer surface of the plug portion 120, 124.

The machined parts 120, 122, 124 are typically assembled prior to sintering to allow the sintering step to bond the parts together. According to an exemplary method of bonding, the densities of the bisque-fired parts used to form the body member 122 and the plug members 120, 124 are selected to achieve different degrees of shrinkage during the sintering step. The different densities of the bisque-fired parts may be achieved by using ceramic powders having different surface areas. For example, the surface area of the ceramic powder used to form the body member 122 may be 6-10 $m^2/g$, while the surface area of the ceramic powder used to form the plug members 120, 124 may be 2-3 $m^2/g$. The finer powder in the body member 122 causes the bisque-fired body member 122 to have a smaller density than the bisque-fired plug members 120, 124 made from the coarser powder. The bisque-fired density of the body member 122 is typically 42-44% of the theoretical density of alumina (3.986 $g/cm^3$), and the bisque-fired density of the plug members 120, 124 is typically 50-60% of the theoretical density of alumina. Because the bisque-fired body member 122 is less dense than the bisque-fired plug members 120, 124 the body member 122 shrinks to a greater degree (e.g., 3-10%) during sintering than the plug member 120, 124 to form a seal around the flange 130. By assembling the three components 120, 122, 124 prior to sintering, the sintering step bonds the two components together to form a discharge chamber.

The sintering step may be carried out by heating the bisque-fired parts in hydrogen having a dew point of about 10-15° C. Typically, the temperature is increased from room temperature to about 1850-1880° C. in stages, then held at 1850-1880° C. for about 3-5 hours. Finally, the temperature is decreased to room temperature in a cool down period. The inclusion of magnesia in the ceramic powder typically inhibits the grain size from growing larger than 75 microns. The resulting ceramic material comprises a densely sintered polycrystalline alumina.

According to another method of bonding, a glass frit, e.g., comprising a refractory glass, can be placed between the body member 122 and the plug member 120, 124, which bonds the two components together upon heating. According to this method, the parts can be sintered independently prior to assembly.

The body member 122 and plug members 120, 124 typically each have a porosity of less than or equal to about 0.1%, preferably less than 0.01%, after sintering. Porosity is conventionally defined as the proportion of the total volume of an article which is occupied by voids. At a porosity of 0.1% or less, the alumina typically has a suitable optical transmittance or translucency. The transmittance or translucency can be defined as "total transmittance", which is the transmitted luminous flux of a miniature incandescent lamp inside the discharge chamber divided by the transmitted luminous flux from the bare miniature incandescent lamp. At a porosity of 0.1% or less, the total transmittance is typically 95% or greater.

According to another exemplary method of construction, the component parts of the discharge chamber are formed by injection molding a mixture comprising about 45-60% by volume ceramic material and about 55-40% by volume binder. The ceramic material can comprise an alumina powder having a surface area of about 1.5 to about 10 $m^2/g$, typically between 3-5 $m^2/g$. According to one embodiment, the alumina powder has a purity of at least 99.98%. The alumina powder may be doped with magnesia to inhibit grain growth, for example in an amount equal to 0.03%-0.2%, e.g., 0.05%, by weight of the alumina. The binder may comprise a wax mixture or a polymer mixture.

In the process of injection molding, the mixture of ceramic material and binder is heated to form a high viscosity mixture. The mixture is then injected into a suitably shaped mold and subsequently cooled to form a molded part.

Subsequent to injection molding, the binder is removed from the molded part, typically by thermal treatment, to form a debindered part. The thermal treatment may be conducted by heating the molded part in air or a controlled environment, e.g., vacuum, nitrogen, rare gas, to a maximum temperature, and then holding the maximum temperature. For example, the temperature may be slowly increased by about 2-3° C. per hour from room temperature to a temperature of 160° C. Next, the temperature is increased by about 100° C. per hour to a maximum temperature of 900-1100° C. Finally, the temperature is held at 900-1100° C. for about 1-5 hours. The part is subsequently cooled. After the thermal treatment step, the porosity is about 40-50%.

The bisque-fired parts are typically assembled prior to sintering to allow the sintering step to bond the parts together, in a similar manner to that discussed above.

In tests formed on the lamps it has been found that lamps can be formed which are capable of operating at a power of at least 200 W, and which can be 300-400 W, or higher, and which are optimized when the L/D follows the relationship $2.0<L/D<3.00$. In one embodiment, the wall thickness is greater than 1.1 mm. In another embodiment, the wall loading is less than 0.20 $W/mm^2$. Under such conditions, a lamp operated with an electronic ballast which has a nominal operating voltage of about 150V can have an Ra of above 75, and efficiency of at least 100 LPW, and in some cases, as high as 110 and lumen maintenance of at least about 75%, in one embodiment, at least 80%.

The lamp can have a Dccy of about 0.010 to 0.030, e.g., about 0.022. Dccy is the difference in chromaticity of the color point, on the Y axis (CCY), from that of the standard black body curve.

Without intending to limit the scope of the present invention, the following example demonstrates the formation of lamps using ceramic vessels with improved performance.

EXAMPLE

Arctubes are formed according to the shape shown in FIG. 3 from three component parts, as illustrated in FIG. 5. The internal diameter D is ~11.0 mm and the internal length L is ~27.0 mm A fill comprising 50 mg halide in the weight ratios 49-59% NaI, 30-40% $CeI_3$, 5% TlI, 2% InI, and 4% CsI is used. The metal halide arctubes are back filled with a rare gas, comprising Ar or Xe and a small addition of Kr85. The cold fill pressure is 120-240 Torr. The arctubes are assembled into lamps having an outer vacuum jacket and a quartz shroud to contain possible arctube rupture, and which are run on ULTRAMAX HID™ electronic ballasts. The arctube leg geometry, leadwire design, seal parameters, and outer jacket are the same for all lamps tested.

Lamps formed as described above are run in a vertical orientation (i.e., as illustrated in FIG. 3) with the lamp cap positioned uppermost at 250 W. TABLE 2 illustrates properties of the lamps. TABLE 3 shows the results obtained after 100 hours. CCX and CCY are the chromaticity X and Y, respectively, on a standard CIE chart. The results are the mean of 4-5 lamps.

TABLE 2

| Run | Arctube Fill | Arctube Fill Pressure(Torr) | Halide Composition % By Weight | Description |
|---|---|---|---|---|
| 1 | Xe | 180 | 54% NaI, 35.0% $CeI_3$, 5% TlI, 2% InI, and 4% CsI | 110 LPW |
| 2 | Xe | 180 | 59% NaI, 30.0% $CeI_3$, 5% TlI, 2% InI, and 4% CsI | Lower cerium to evaluate LPW/LM % effects |
| 3 | Xe | 180 | 49% NaI, 40.0% $CeI_3$, 5% TlI, 2% InI, and 4% CsI | Higher cerium to evaluate LPW/LM % effects |
| 4 | Xe | 240 | 54% NaI, 35.0% $CeI_3$, 5% TlI, 2% InI, and 4% CsI | Higher xenon fill pressure to evaluate LPW/LM % effects |
| 5 | Xe | 120 | 54% NaI, 35.0% $CeI_3$, 5% TlI, 2% InI, and 4% CsI | Lower xenon fill pressure to evaluate LPW/LM % effects |
| 6 | Ar | 120 | 54% NaI, 35.0% % $CeI_3$, 5% TlI, 2% InI, and 4% CsI | Effect of argon vs xenon |

TABLE 3

| | | Run | | | | | |
|---|---|---|---|---|---|---|---|
| | | 1 | 2 | 3 | 4 | 5 | 6 |
| Watts | Mean | 250.0 | 249.9 | 250.0 | 250.1 | 249.9 | 249.7 |
| | STD Dev. | 0.3 | | | | | |
| Lumens | Mean | 27783 | 27412 | 28213 | 27764 | 27472 | 27090 |
| | STD Dev. | 385 | | | | | |
| CCX | Mean | 0.3848 | 0.3918 | 0.3795 | 0.3874 | 0.3822 | 0.3891 |
| | STD Dev. | 0.0042 | | | | | |
| CCY | Mean | 0.4011 | 0.3984 | 0.4043 | 0.3990 | 0.4029 | 0.3971 |
| | STD Dev. | 0.0033 | | | | | |
| CCT | Mean | 4051 | 3868 | 4204 | 3976 | 4129 | 3926 |
| | STD Dev. | 116 | | | | | |
| CRI | Mean | 79 | 79.5 | 79.0 | 78.8 | 79.4 | 79.3 |
| | STD Dev. | 1.1 | | | | | |
| LPW | Mean | 111.1 | 110 | 113 | 111 | 110 | 109 |
| | STD Dev. | 1.6 | | | | | |

The invention has been described with reference to the preferred embodiments. Obviously, modifications and alterations will occur to others upon reading and understanding the preceding detailed description. It is intended that the invention be construed as including all such modifications and alterations.

What is claimed is:

1. A ceramic metal halide lamp comprising:

a discharge vessel formed of a ceramic material which defines an interior space;

an ionizable fill disposed in the interior space, the ionizable fill comprising an inert gas and a halide component, the halide component consisting of a sodium halide, a cerium halide, a thallium halide, and a cesium halide, the cerium halide comprising at least 9 mol % of the halide component, the sodium halide comprising at least 47 mol % of the halide component, the cesium halide comprising at least 1.5 mol % of the halide component; and at least one electrode positioned within the discharge vessel so as to energize the fill when an electric current is applied thereto.

2. The lamp of claim 1, wherein the sodium halide is least 59 mol % of the halides in the fill.

3. The lamp of claim 1, wherein the cerium halide is at least 12 mol % of the halides in the fill.

4. The lamp of claim 1, wherein thallium halide is at least 1.2 mol %.

5. The lamp of claim 1, wherein the halides of sodium, cerium, thallium, and cesium, where present, comprise at least 90% of the weight of halides in the fill.

6. The lamp of claim 1, wherein the halide component comprises 58-83 mol % sodium halide, 9-22 mol % cerium halide, 2-8 mol % thallium halide, and 1.5-10.0 mol % cesium halide.

7. The lamp of claim 1, wherein the discharge vessel includes a body which is substantially cylindrical.

8. The lamp of claim 1, wherein the discharge vessel includes a body portion having an internal length, parallel to a central axis of the discharge vessel and an internal diameter, perpendicular to the internal length, wherein a ratio of the internal length to the internal diameter is in the range of 1.5 to 3.5.

9. The lamp of claim 8, wherein the ratio of the internal length to the internal diameter is in the range of 2.0-3.0.

10. The lamp of claim 1, wherein the inert gas comprises at least one of xenon and argon.

11. The lamp of claim 1, wherein the fill pressure is at least 60 Torr.

12. The lamp of claim 1, wherein at least one of the following conditions is satisfied:

a) the lamp has a color rendition index of at least 75;

b) the lamp has an efficiency of at least 100 lumens/watt at 100 hours;

c) the lamp has a lumen maintenance of at least 80%.

13. The lamp of claim 12, wherein the lamp has a color rendition index of at least 75 and an efficiency of at least 110 lumens/watt at 100 hours.

14. The lamp of claim 1, wherein the lamp is capable of operating at a power of at least 150 W.

15. A lighting assembly comprising:

the lamp of claim 1; and a ballast.

16. The lighting assembly of claim 15, wherein the ballast is an electronic ballast.

17. A ceramic metal halide lamp comprising:

a discharge vessel formed of a ceramic material which defines an interior space;

an ionizable fill disposed in the interior space, the ionizable fill comprising an inert gas and a halide component, the halide component consisting of a sodium halide, a cerium halide, a thallium halide, an indium halide, and a cesium halide, the cerium halide comprising at least 9 mol % of the halide component, the sodium halide comprising at least 47 mol % of the halide component, the cesium halide comprising at least 1.5 mol % of the halide component; and at least one electrode positioned within the discharge vessel so as to energize the fill when an electric current is applied thereto.

18. The lamp of claim 17, wherein the sodium halide is least 59 mol % of the halides in the fill.

19. The lamp of claim 17, wherein the cerium halide is at least 12 mol % of the halides in the fill.

20. The lamp of claim 17, wherein indium halide is at least 1 mol %.

21. The lamp of claim 17, wherein thallium halide is at least 1.2 mol %.

22. The lamp of claim 17, wherein the halides of sodium, cerium, thallium, indium, and cesium, where present, comprise at least 90% of the weight of halides in the fill.

23. The lamp of claim 17, wherein the halide component comprises 58-83 mol % sodium halide, 9-22 mol % cerium halide, 2-8 mol % thallium halide, and 1.5-10.0 mol % cesium halide.

24. The lamp of claim 17, wherein the discharge vessel includes a body which is substantially cylindrical.

25. The lamp of claim 17, wherein the discharge vessel includes a body portion having an internal length, parallel to a central axis of the discharge vessel and an internal diameter, perpendicular to the internal length, wherein a ratio of the internal length to the internal diameter is in the range of 1.5 to 3.5.

26. The lamp of claim 25, wherein the ratio of the internal length to the internal diameter is in the range of 2.0-3.0.

27. The lamp of claim 17, wherein the inert gas comprises at least one of xenon and argon.

28. The lamp of claim 17, wherein the fill pressure is at least 60 Torr.

29. The lamp of claim 17, wherein at least one of the following conditions is satisfied:

a) the lamp has a color rendition index of at least 75;

b) the lamp has an efficiency of at least 100 lumens/watt at 100 hours;

c) the lamp has a lumen maintenance of at least 80%.

30. The lamp of claim 17, wherein the lamp has a color rendition index of at least 75 and an efficiency of at least 110 lumens/watt at 100 hours.

31. The lamp of claim 17, wherein the lamp is capable of operating at a power of at least 150 W.

32. A lighting assembly comprising:

the lamp of claim 17; and a ballast.

33. The lighting assembly of claim 17, wherein the ballast is an electronic ballast.

* * * * *